United States Patent [19]

Barlow

[11] 4,114,121

[45] Sep. 12, 1978

[54] APPARATUS AND METHODS FOR LAUNCHING AND SCREENING ELECTROMAGNETIC WAVES IN THE DIPOLE MODE

[75] Inventor: Harold Everard Monteagle Barlow, Epsom, England

[73] Assignee: National Research Development Corporation, London, England

[21] Appl. No.: 755,844

[22] Filed: Dec. 30, 1976

[30] Foreign Application Priority Data

Jan. 16, 1976 [GB] United Kingdom ..... 01736/76

[51] Int. Cl.[2] ..... H01P 1/16; H01P 3/00

[52] U.S. Cl. ..... 333/95 R; 333/98 R; 333/98 M

[58] Field of Search ..... 333/98 R, 95 S, 21 R, 333/21 A, 98 M, 95 R

[56] References Cited

U.S. PATENT DOCUMENTS

| | | | |
|---|---|---|---|
| 2,677,055 | 4/1954 | Allen | 343/785 |
| 3,668,574 | 6/1972 | Barlow | 333/95 S |
| 3,845,426 | 10/1974 | Barlow | 333/95 S |
| 3,990,026 | 11/1976 | Barlow | 333/98 R |

FOREIGN PATENT DOCUMENTS 1,078,304 8/1967 United Kingdom.

OTHER PUBLICATIONS

Barlow, "Screened Surface Waves and some Possible Applications", Proc. IEEE, vol. 112, No. 3, Mar. 1965, pp. 477–482.

King, "Transmission Line Theory", McGraw-Hill, 1955, pp. 35–39.

Beam et al., "Shielded Dielectric Rod Waveguides", AIEE Trans., vol. 70, 1955, pp. 874–880.

*Primary Examiner*—Alfred E. Smith
*Assistant Examiner*—Marvin Nussbaum
*Attorney, Agent, or Firm*—Cushman, Darby & Cushman

[57] ABSTRACT

A screen for a dipole-mode waveguide is described. The screen is in the form of a metal cylinder, with or without longitudinal gaps, and this screen is useful with the type of dipole-mode waveguide formed by a generally cylindrical structure of elongated parallel spaced apart conductors. External radial vanes and an internal diametric vane for the structure are also described for suppressing unwanted modes at the launching point, as is a slot launching arrangement for launching the dipole mode without exciting unwanted modes.

26 Claims, 5 Drawing Figures

Figure 2:
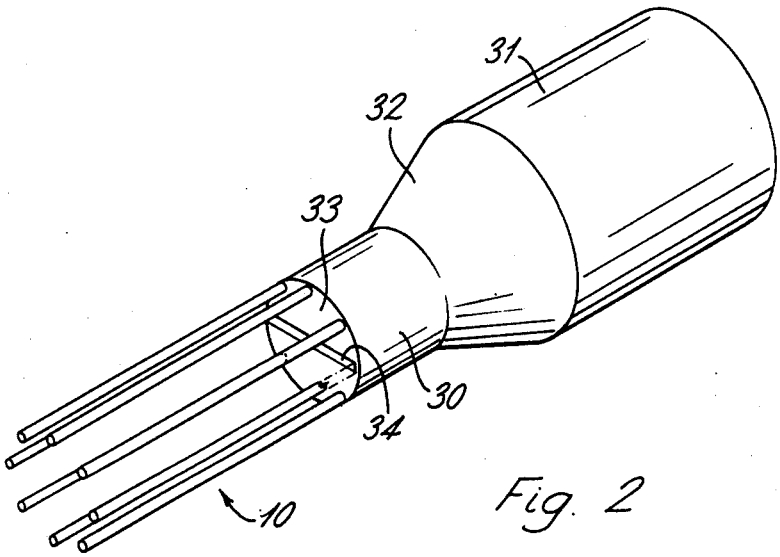

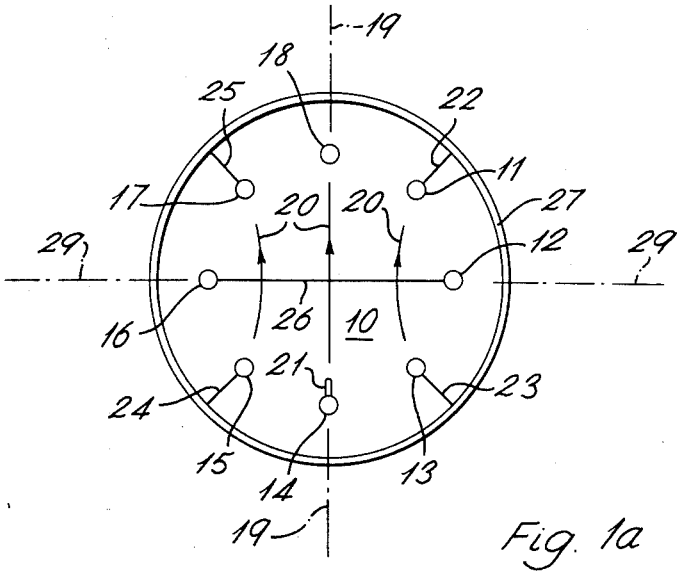
Fig. 1a
Fig. 1b
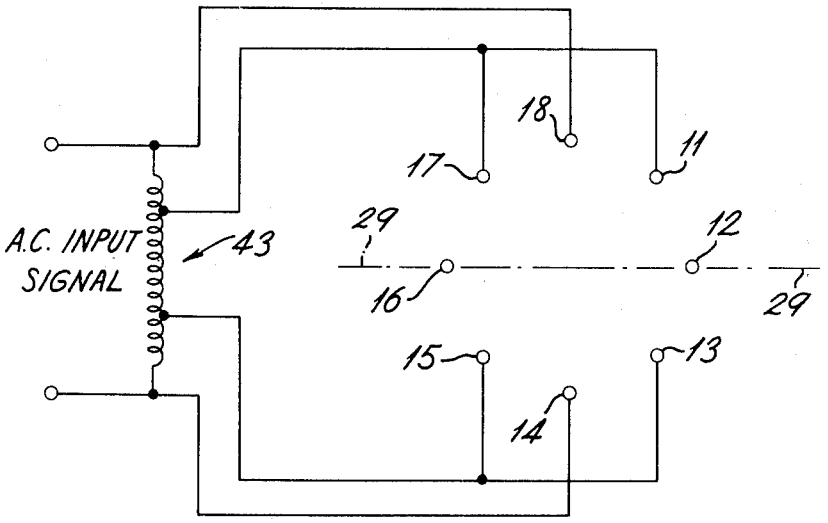

APPARATUS AND METHODS FOR LAUNCHING AND SCREENING ELECTROMAGNETIC WAVES IN THE DIPOLE MODE

The present invention relates to methods and apparatus for launching electromagnetic waves in the dipole mode and screening dipole mode waveguides.

An explanation of the dipole mode and a description of various waveguides for supporting this mode are given by the present inventor in U.S. Pat. Nos. 3,845,426 and 3,990,026 and U.S. Application Ser. No 672,600, now U.S. Pat. No. 4,051,450.

A problem which sometimes arises in launching the dipole mode is that propagation in other modes, particularly varieties of T.E.M. mode, also occurs.

Since a waveguide for the dipole mode often comprises a number of elongated conductors which are spaced apart from one another, but which together form a hollow structure, evanescent electric and magnetic fields exist outside the hollow structure and these fields may interfere with other electrical systems in close proximity.

According to a first aspect of the present invention there is provided apparatus for launching electromagnetic waves in the dipole mode, including a structure capable of supporting electromagnetic waves in the dipole mode, launching means for exciting the structure to provide an electric and/or magnetic field forming at least part of the field which exists when propagation occurs in a predetermined low order dipole mode, and suppression means for eliminating or attenuating, in relation to the predetermined order dipole mode, propagation in one or more higher order dipole modes and/or one or more other modes of electromagnetic waves when these are also excited by the launching means.

Preferably the predetermined order of dipole mode is the lowest order.

Clearly the advantage of apparatus according to the first aspect of the invention is that low order dipole modes are able to exist while higher orders and other modes of transmission are relatively inhibited or severely attenuated so that if these higher orders or other modes tend to be excited they are disposed of before propagation along the waveguide can occur.

The suppression means may comprise a number of electrically conductive vanes positioned parallel with the electric fields of unwanted modes but not parallel with any component of the electric field of the dipole mode.

As described in U.S. Pat. No. 3,990,026 a waveguide for the dipole mode may comprise a number of spaced apart elongated conductors parallel to the direction of propagation of waves in the dipole mode. These conductors may be of circular cross section and may be arranged on a cylindrical surface (real or imaginary). When a waveguide of this type is used the suppression means may comprise a plurality of vanes external and radial to the cylindrical surface each vane being positioned adjacent to a different longitudinal conductor but not one lying in the plane of polarization. The vanes may be constructed of metal such as copper, should have a radial length about equal to the radius of the guide structure and a longitudinal dimension of about a quarter wavelength. The vanes are positioned at the launching point.

In addition, or alternatively, a vane of similar construction may extend across an internal diameter of the cylinder corresponding to the ground plane of the dipole mode.

Where the waveguide comprises a cylindrical structure of spaced apart elongated conductors the launching means may include a coaxial cable, the outer conductor of which forms part of one of the elongated conductors and the inner conductor of which passes through an aperture in the outer to form a probe radial to the structure. Launching is then achieved by applying an input signal to the coaxial cable. Instead, for launching signals of comparatively low frequencies, the launching means may comprise a two-wire input line, excited in the balanced T.E.M. mode, and connected with the full signal voltage between two diametrically opposite elongated conductors. Preferably intermediate potential differences are applied between other conductor pairs, comprising conductors on opposite sides of the ground plane and on chords parallel to the plane of polarization.

According to a second aspect of the present invention there is provided apparatus for launching electromagnetic waves in the dipole mode, including a structure capable of supporting electromagnetic waves in the dipole mode, electrically conducting material defining an elongated slot transverse to the direction of propagation of electromagnetic waves in the dipole mode along the said structure, the conducting material at least partially forming a wall across the said structure transverse to the said direction, and means for exciting the slot to provide an electric field between the longitudinal edges thereof which is approximately the same sine distribution over its length as the lowest order dipole mode electric field is over the waveguide structure in the vicinity of the slot when the structure supports propagation in the lowest order dipole mode.

Where the structure is formed by spaced apart elongated conductors positioned on the periphery of a cylindrical surface (real or imaginary), the slot extends along a diameter of the cylindrical surface and preferably across the whole diameter.

In any case the electric field variation along the slot from one end to the other should approximately correspond to the lowest order dipole mode electric field which is sinusoidal varying from zero at one end of a diameter through a maximum at the centre to zero at the other end.

By using launching apparatus according to the second aspect of the invention with a full length slot and sinusoidal variation substantially no higher order modes or other modes of propagation are excited. Such a variation may be conveniently provided when the means for exciting the slot includes a cylindrical waveguide operating in the $TE_{11}$ mode and having an end wall formed by the material defining the slot, and means for setting up the required field in the cylindrical waveguide. The transverse dimensions of the cylindrical waveguide are usually such that the $TE_{11}$ field is evanescent, i.e. the waveguide is "cut off" but the waveguide may be filled with high permittivity dielectric to allow the $TE_{11}$ mode to propagate freely.

According to a third aspect of the present invention there is provided apparatus for supporting electromagnetic waves in the dipole mode, including a structure capable of supporting electromagnetic waves in the dipole mode, the structure being generally circular in cross section and comprising spaced apart conductors elongated in the general direction of propagation, and a screen of conducting material at least partially enclosing the said structure and positioned outside it in a region where the electromagnetic field is evanescent when the structure supports propagation in the dipole mode.

Preferably the diameter of the screen and the dielectric constants of any dielectric layers or filling, or materials within the screen should be such that transverse resonant waveguide modes, that is fast waves, at the frequency of propagation in the dipole mode, cannot propagate within the screen. In this way one class of spurious transmission modes are avoided.

When the elongated conductors are positioned on the periphery of a cylindrical surface (real or imaginary), the screen may be a cylinder of conducting material external to the structure and separated therefrom. Preferably however the conducting cylinder is divided into two halves spaced apart by diametrically opposite gaps running parallel to the direction of propagation, the diameter joining the gaps being that diameter along which maximum electric field occurs when the dipole mode propagates.

While it is advantageous to make the energy storage of the structure large in order to raise the level of power transfer, the gap between the structure and the screen must be large enough to permit sufficient decay of the outer evanescent field as it approaches the screen. Preferably, as a compromise, the radius of the structure should not be more than about two thirds that of the screen.

There may be a tendency for a T.E.M. mode to be set up between the screen and the two elongated conductors which are in the plane of polarization since these conductors carry relatively high longitudinal currents and corresponding currents are induced in the screen adjacent to them. The tendency is avoided by having gaps in the screen, which may be quite large, where the induced currents mentioned above would flow.

A screen of this type accentuates the evanescence of the field outside the structure and at an appropriate radius can reduce the overall attenuation as well as providing screening.

The screen of the third aspect of the present invention may be used with the launching means of the first and second aspects of the invention. Where it is used with the above mentioned external radial vanes, these vanes may extend from the said structure to the screen, and where the screen is used with the diametric vane or with the second aspect of the invention the diametric vane or the slot is normal to the diameter joining the said gaps (if provided) in the screen.

Many of the other types of waveguide and resonators described in the above mentioned specifications and applications may be used as the said structure in the three aspects of the invention.

In this specification the term "dipole mole" means any of the hybrid types $EH_{n-}$ or $HE_{n-}$ waves where the letters E and H signify that there are electric and magnetic field components in the longitudinal direction, the subscript n to one of these letters signifies the number of periods of variation of the transverse field associated with that letter, either in the circumferential direction, for generally circular cross section waveguides, or, for waveguides having generally parallel conducting surfaces, in the transverse direction normal to the surfaces, and where the subscript '—' signifies that in the radical direction, or in the transverse direction parallel to the said surfaces, the said transverse field in evanescent. Thus when $n > 1$ the same basic field configuration as for the lowest order mode $n = 1$ is included $n$ times within the circumference of 360°, and the dispositions of the elements with spatial significance have to be adjusted accordingly. The case of $n = 1$ is in application the most important because losses are lower. Where the waveguide employs a conducting surface (known as the ground plane) acting as an image line, the axis of propagation, in this specification, is along the conducting surface, imaginary fields on that side of the surface remote from the real fields completing a symmetrical field. Thus the half dipole mode which occurs when an image line is used, is considered, for the purposes of this specification, as a form of the dipole mode.

Figure 3:
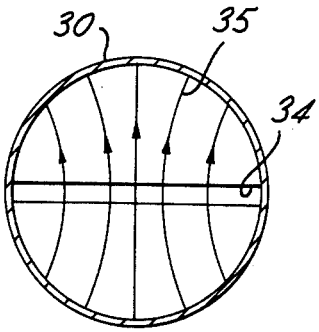
Figure 4:
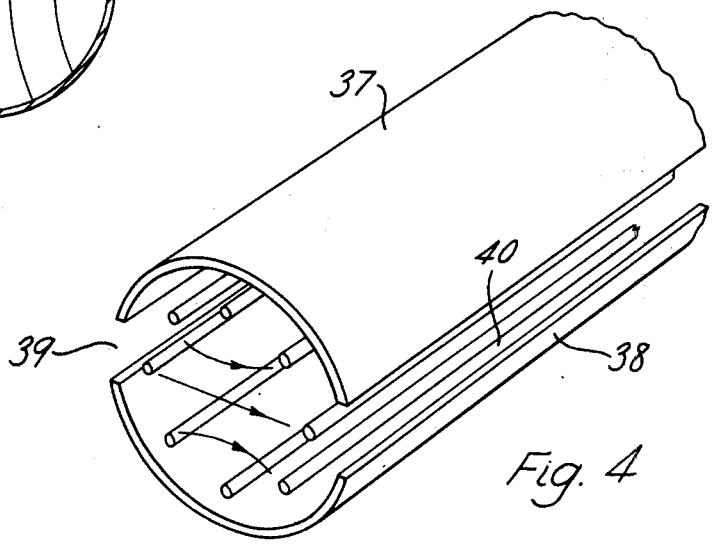

Certain embodiments of the invention will now be described by way of example with reference to the accompanying drawings, in which:

FIG. 1*a* shows a cross section of a dipole mode launching apparatus and waveguide according to the first and third aspects of the present invention, FIG. 1*b* is a schematic diagram of another dipole mode launching apparatus according to the first aspect of the present invention, FIG. 2 shows dipole mode launching apparatus according to the second aspect of the invention, FIG. 3 illustrates a field existing in the apparatus of FIG. 2, and FIG. 4 shows a dipole mole waveguide according to the third aspect of the present invention.

In FIG. 1*a* a dipole mode wavegude 10, shown in cross section, comprises eight elongated conductors 11 to 18 normal to the plane of the figure. When the lowest order dipole mode propagates along the waveguide a component electric field as indicated by the lines 20 exists in the waveguide. Of course other component fields also exist including a transverse magnetic component, not shown, and longitudinal electric and magnetic components which are also not shown. The plane of polarization is indicated by chain-dotted lines 19 while the ground plane is indicated by chain-dotted lines 29.

The conductor 14 is partially formed from the outer of a coaxial line, and a probe 21 connected to the inner conductor of the line extends towards the interior of the waveguide 10 through an aperture, not visible in FIG. 1*a*, in the outer of the line. An alternating signal voltage is applied between the inner and outer conductors of the coaxial line to set up an electric field between the probe and the outer in order to launch the dipole mode.

However instead of using the probe 21, particularly where low frequencies are to be launched, two-wire input line may be connected between the conductors 14 and 18 and an alternating signal voltage applied between the two wires of the line so that they are fed in the T.E.M. mode. As shown in FIG. 1*b* the conductors 14 and 18 are fed from an auto-transformer 43 which feeds intermediate signal voltages across the pair of conductors 15 and 17 and also the pair 11 and 13. The input signal is supplied to the input of the auto-transformer.

when the lowest dipole mode is launched in either of these ways other dipole modes and other modes of electromagnetic waves may also be excited. In order to prevent the unwanted modes from propagating four vanes 22 to 25 are provided but only in the region of the probe 21. In addition a further vane 26 extends, again in the said region only, between the conductors 12 and 16. The vanes 22 to 26 are preferably of copper sheet.

In order to prevent interference with other electrical apparatus by evanescent fields external to the waveguide structure formed by the conductors 11 to 18, a continuous shield of conducting material 27 can enclose the waveguide structure, with the vanes 22 to 25 extending to the screen, but it may be preferable to make the screen in two parts as indicated below in connection with FIG. 4.

Further the diameter of the screen 27 should preferably be such that resonant waveguide modes at the frequency of the alternating current signal applied by the probe 21 on the auto-transformer 43 are "cut-off", that is fast waves cannot propagate. As shown the waveguide 10 is air filled, but in the form of a practical cable it will usually be partly or wholly filled with dielectric material, to support the conductors and screen, for example. The diameter of the screen and the dielectric constants of all materials within the screen should then be so chosen that the cylinder formed by the screen operates to "cut-off" all transverse resonant waveguide modes.

As can be seen from FIG. 1*a* the conductors 11 to 18 are arranged to form a cylindrical structure and the radius of the structure should not as a rule be more than about two thirds that of the screen 27.

FIG. 2 shows another arrangement for launching the lowest order dipole mole in which a dipole waveguide 10 of the same general form as that shown in FIG. 1*a* but without the vanes or the screen 27 is attached to a cylindrical waveguide 30. The waveguide 30 may be fed from a waveguide 31 coupled by way of tapering section 32 so that a required field distribution for launching the dipole mode is set up along a slot 34. In launching, the $TE_{11}$ mode is propagated in the waveguide 31 which is full size and sets up corresponding evanescent fields in the waveguide 30, the dimensions of which are such that the $TE_{11}$ mode cannot propagate, that is the waveguide is "cut-off" with respect to the $TE_{11}$mode.

The waveguide 30 may, instead, be filled with a high permittivity dielectric so that it is not "cut-off", and then the sections 31 and 32 are no longer required. In another arrangement the $TE_{11}$ mode may be launched in the waveguide 30 which may be cut-off so that an evanescent field sets up the required field distribution across the slot, but preferably in this case the waveguide 30 and its internal dielectric should nearly allow propagation.

The cut-off waveguide 30 has a conducting transverse wall 33 defining the elongated slot 34. Thus when the $TE_{11}$ mode with electric field as shown by the lines 35 in FIG. 3 exists in the waveguide 30 an electric field exists across the slot 34. This field is normal to the length of the slot and varies from zero through a maximum back to zero as the slot is traversed from one end to the other. When the lowest order dipole mode propagates in the waveguide 10, its transverse electric component has a sinusoidal variation along the length of the slot 34. The field of the $TE_{11}$ wave in the waveguide 30 substantially provides this variation, so launching the dipole mode in the waveguide 10.

The slot is made very narrow if the waveguide 10 forms part of a resonator thus avoiding the loss of reflected power back into the slot but where the waveguide is for communication the slot is fairly wide to allow maximum power to be launched. Where a wide slot is used means are provided to match the waveguide 10 to means for launching the $TE_{11}$ wave in the waveguide 30.

If the lowest order dipole mode is launched by the apparatus of FIG. 2 propagation in higher dipole modes and other modes is practically non-existent and can be ignored.

A split cylindrical screen comprising two halves 37 and 38 is shown in FIG. 4. This screen is preferable to that shown in FIG. 1 since it does not attenuate the dipole mode to the same extent as a complete cylindrical screen and may even reduce attenuation in comparison with an unscreened dipole waveguide. Where the dipole mode is launched by the apparatus of FIG. 1 the diameter joining gaps 39 and 40 between the two halves of the screen must be coincident with the diameter joining the conductors 14 and 18 of FIG. 1. If the slot launching arrangement of FIG. 2 is used the slot 34 must be normal to the diameter joining the gaps 39 and 40.

The cylindrical screen, either split or continuous, may be positioned at a distance outside the structure of elongated conductors about equal to the radius of the structure, but the position of the screen may be varied widely.

The arragements of FIGS. 1*a* to 4 may be modified for use with many of the other waveguides described in the above mentioned applications and specifications.

The screened cylindrical dipole mode waveguides described are capable of being used over a very wide frequency range from, for example, 50 Hz to 3 Giga Hz and higher.

I claim:

1. Electromagnetic wave apparatus including a structure capable of supporting electromagnetic waves in the dipole mode, the structure being generally circular in cross section and comprising spaced apart conductors elongated in the general direction of propagation, and a screen of conducting material at least partially enclosing the said structure and positioned outside it in a region where the electromagnetic field is evanescent when the structure supports propagation in the dipole mode.

2. Apparatus according to claim 1 wherein the elongated conductors are parallel to one another and are positioned on the periphery of a real or imaginary cylindrical surface, the screen is cylindrical in shape, and is positioned external to the structure and separated therefrom.

3. Apparatus according to claim 2 including means for launching electromagnetic wves in the dipole mode at a prodetermined frequency along said structure wherein the radius of the screen and the dielectric properties of materials and members within the screen are such that electromagnetic waves at said frequency cannot propagate in any transverse resonant mode within the screen.

4. Appartus according to claim 2 wherein the radius of the cylindrical surface is equal to, or less than, two thirds of the radius of the screen.

5. Apparatus according to claim 2 wherein the screen is divided into two halves spaced apart by diametrically opposite gaps parallel to the direction of propagation.

6. Apparatus according to claim 2 including a portion for the suppression of propagation in unwanted dipole or other modes which comprises a plurality of electrically conductive vanes external and radial to the said cylindrical surface, each vane being positioned adjacent to a different elongated conductor but at least two diametrically opposed conductors being without vanes.

7. Apparatus according to claim 6 wherein each vane has a radial length which is approximately equal to the radius of the cylindrical surface.

8. Apparatus according to claim 7 for use over a predetermined range of frequencies wherein the length of each vane in the direction of propagation is approximately a quarter of a wavelength at the centre frequency of the said range.

9. Apparatus according to claim 2 including a portion for the suppression of propagation in unwanted modes which comprises an electrically conductive vane extending across an internal diameter of the cylindrical surface.

10. Apparatus according to claim 6 wherein the said portion includes an electrically conductive vane extending across the internal diameter of the cylindrical surface which is at right angles to the diameter joining the said diametrically opposed conductors.

11. Apparatus according to claim 6 wherein the said portion is constucted to allow the launching of electromagnetic waves in the dipole mode.

12. Apparatus according to claim 11 wherein, in the said portion, one of the said diametrically opposed conductors is formed by the outer conductor of a coaxial line, and a conductive probe extends from the inner conductor of the line, through an aperture in the outer conductor into the said structure in a direction radial to the said cylindrical surface.

13. Apparatus according to claim 11 including a two wire input line with respective wires connected to the said diametrically opposed conductors and means for exciting the two wire input line in the balanced T.E.M. mode.

14. Apparatus according to claim 11 including means for applying potential differences intermediate to those applied to the diametrically opposed conductors to other pairs of the said elongated conductors, each pair comprising conductors positioned at the ends of chords of the cylindrical surface parallel to that diameter thereof joining the said diametrically opposed conductors.

15. Apparatus according to claim 11 including electrically conducting material defining an elongated slot along a diameter of the cylindrical surface and transverse to the direction of propagation of electromagnetic waves in the dipole mode along the said structure, the conducting material at least partially forming a wall across the said structure transverse to the said direction, and means for exciting the slot to provide an electric field between the longitudinal edges thereof which is approximately the same sine distribution over its length as the lowest order dipole mode electric field is over the waveguide structure in the vicinity of the slot when the structure supports propagation in the dipole mode.

16. Apparatus according to claim 15 wherein the means for exciting the slot includes a cylindrical waveguide constructed to support the $TE_{11}$ mode in evanescent or propagating form and having a transverse end wall defining the said slot, and means for setting up the $TE_{11}$ mode in the cylindrical waveguide.

17. Apparatus according to claim 16 including a further cylindrical waveguide of greater diameter than the waveguide which defines the said slot, and a tapering waveguide section which joins the walls of the two cylindrical waveguides to one another end to end.

18. Apparatus for launching electromagnetic waves in the dipole mode, including:

transmission means for supporting electromagnetic waves in a dipole mode, launching means operatively associated with the tranmission means for exciting the transmission means by providing an electric and/or a magnetic field forming at least part of the field which exists in the transmission means when propagation occurs in a predetermined low order dipole mode, and suppression means operatively associated with said transmission means for eliminating or attenuating, in relation to the predetermined order dipole mode, propagation in one or more higher order dipole modes.

19. Apparatus according to claim 18 or launching in the lowest order dipole mode, wherein the predetermined low order dipole mode is the lowest order dipole mode and the launching means provides, in operation, part of the field which exists when propagation occurs in the lowest order dipole mode.

20. Apparatus according to claim 19 wherein the suppression means includes at least one electrically conducting vane positioned to allow electromagnetic waves in the dipole mode to propagate without components of the electric fields thereof being parallel to the vane or one of the vanes but positioned also to be parallel to an electric field component of an least one unwanted mode.

21. Apparatus according to claim 19 wherein the transmission means cmprises spaced apart parallel elongated conductors positioned on the periphery of a real or imaginary cylindrical surface and the suppression means includes a plurality of electrically conductive vanes external and radial to the said cylindrical surface, each vane being positioned adjacent to a different elongated conductor but at least two diametrically opposed conductors being without vanes.

22. Apparatus according to claim 19 wherein the transmission means comprises spaced apart parallel elongated conductors positioned on the periphery of a real or imaginary cylindrical surface, and the suppression means includes an electrically conductive vane extending across an internal diameter of the said cylindrical surface.

23. Apparatus according to claim 21 wherein the suppression means also includes an electrically conductive vane extending across that internal diameter of the cylindrical surface which is at right angles to the diameter joining the said diametricallly opposed conductors.

24. Apparatus for launching electromagnetic waves in the lowest order dipole mode, including a structure capable of supporting electromagnetic waves in the dipole mode, electrically conducting material defining an elongated slot transverse to the direction of propagation of electromagnetic waves in the dipole mode along the said structure, the conducting material at least partially forming a wall across the said structure transverse to the said direction, and means for exciting the slot to provide an electric field between the longitudinal edges thereof which is approximately the same sine distribution over its length as the lowest order dipole mode electric field is over the waveguide structure in the vicinity of the slot when the structure supports propagation in the lowest order dipole mode.

25. Apparatus according to claim 24 wherein the structure is formed by spaced apart parallel elongated conductors positioned on the periphery of a real or imaginary cylindrical surface, and the slot extends along a diameter of the cylindrical surface.

26. Apparatus according to claim 25 wherein the means for exciting the slot includes a cylindrical waveguide constructed to support the $TE_{11}$ mode in evanescent or propagating form and having a transverse end wall defining the said slot, and means for setting up the $TE_{11}$ mode in the cylindrical waveguide.

* * * * *